United States Patent [19]

Schaper

[11] 3,969,913

[45] July 20, 1976

[54] CONTRA-FLOW WASHING MACHINE

[76] Inventor: Karl Schaper, Triftstr. 25, D 3203 Sarstedt, Germany

[22] Filed: Oct. 21, 1974

[21] Appl. No.: 516,432

[30] Foreign Application Priority Data

Oct. 22, 1973 Germany ..... 7337934[U]

[52] U.S. Cl. ..... 68/143; 134/65; 134/69

[51] Int. Cl.[2] ..... D06F 37/08

[58] Field of Search ..... 68/58, 139, 142–146, 68/210, 158; 259/3, 30; 134/65, 69, 158; 51/164

[56] References Cited

UNITED STATES PATENTS

| | | | |
|---|---|---|---|
| 2,337,137 | 12/1943 | Thompson et al. | 68/144 X |
| 3,103,802 | 9/1963 | Streich | 68/58 X |
| 3,330,139 | 7/1967 | Schafer | 68/58 |
| 3,336,768 | 8/1967 | Kleefisch | 68/58 |
| 3,878,699 | 4/1975 | Steinort | 68/145 |

*Primary Examiner*—Stanley N. Gilreath
*Assistant Examiner*—Philip R. Coe
*Attorney, Agent, or Firm*—Eric P. Schellin

[57] ABSTRACT

A contra-flow washing machine comprising preferably a horizontal drum, driving means for rotating said drum, for oscillatory motion alternatively in one direction and in reverse direction, and for driving and conveying motion in a single direction only, a plurality of partition means for subdividing the interior of said drum into a plurality of zones of washing and for conveying the washing from one of said zones of washing into the next adjacent one, a plurality of partition means within each cross section part of said drum, each of said partition means including a flat partition part transverse to the axis of said drum and a following guide part spirally inclined to the partition part inside the drum, of which at least one part is disposed within the range of oscillatory motion of the drum for the washing process.

2 Claims, 3 Drawing Figures

CONTRA-FLOW WASHING MACHINE

This invention relates to contra-flow washing machines.

Previously proposed washing drums having continuous spiral partitions are not fully satisfactory because the washing inside the drum is worn out at the spiral partition walls. It has been attempted to overcome these disadvantages by replacing the spiral partitions by semi-circular flat partitions mounted in profile transversely to the axis of the drum and by subsequent inclined or spirally shaped semi-circular walls within the cross section of the drum. However, it has been ascertained that with such structures the agitation of the washing pieces with each other during their passage through the drum by changing the motion direction of the washing is not sufficient for the washing and cleaning effect, as the motion of the washing is being changed only one in each cross section of the drum and only in one direction.

The washing machine of the present invention accomplishes a change in the motion direction into a plurality of directions in each cross section of the drum for better agitation of the washing pieces with each other by various oscillatory movements and for better washing and cleaning effect.

The invention meets these requirements as well as a general demand in practice in a much improved manner by subdividing each cross section of the drum into a plurality of preferably equal partition means, each of them comprising a partition section transverse to the axis of the drum and a subsequent guiding wall part spirally inclined thereto, adapted to subdivide each cross section of the drum into a plurality of washing zones for increased agitation and cleaning effect of the washing pieces with each other during their passage through the drum, of which at least one part is disposed within the range of oscillatory motion of the drum for the washing process.

The invention will be further described in connection with the accompanying drawings which are to be considered as exemplary of the invention and do not constitute a limitation thereof.

Figure 1:
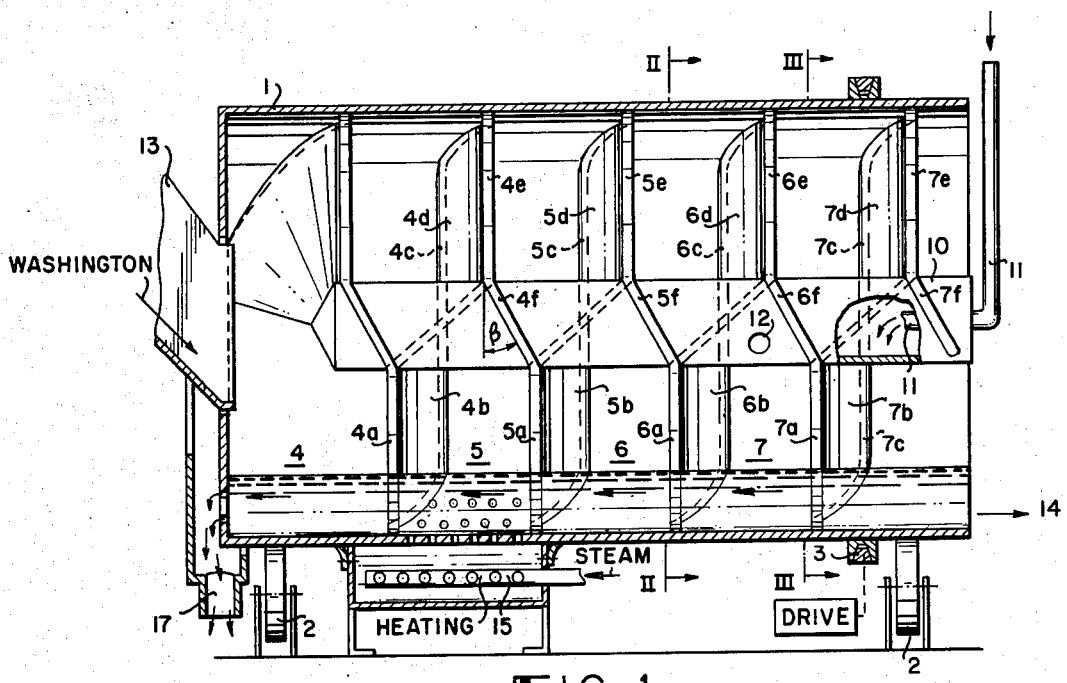
FIG. 1 is a side elevation, partially in section, of a washing machine drum in accordance with the present invention.

In the drawing a preferably horizontal washing drum is denoted by 1. The drum 1 is supported by parallel rollers 2 and driven directly by driving means 3 or by means of the rollers 2 for oscillatory motion alternatively in one direction and in reverse direction or for conveying motion in a single direction only. In the interior of the washing drum 1 there are mounted a plurality of subsequent partition means in order to subdivide the drum into a plurality of zones of washing 4–7 for a continuous conveyance of the washing from one zone of washing into the next one. Within each of the cross sections of the drum there are, for instance, mounted three subsequent partition means. Each of said partition means includes a flat partition part 4*a*, 4*c*, 4*e*, 5*a*, 5*c*, 5*e*, 6*a*, 6*c*, 6*e*, 7*a*, 7*c*, 7*e*, transverse to the axis of the drum and a following guide wall part 4*b*, 4*d*, 4*f*, 5*b*, 5*d*, 5*f*, 6*b*, 6*d*, 6*f*, 7*b*, 7*d*, 7*f*, inclined thereto.

Figure 2:
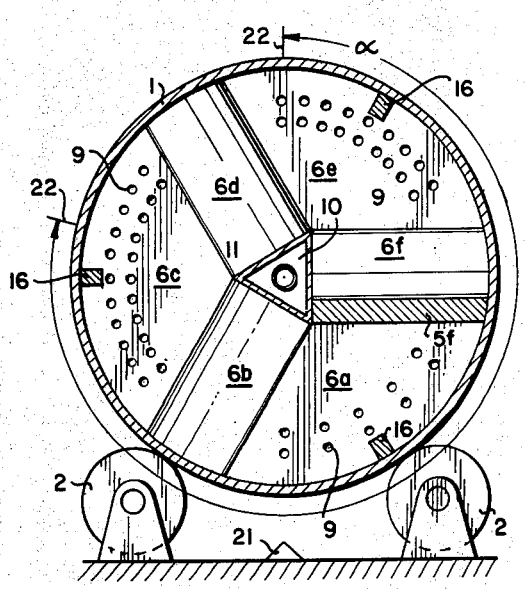
FIG. 2 is a cross-section view upon the drum from the line II—II of FIG. 1.
Figure 3:
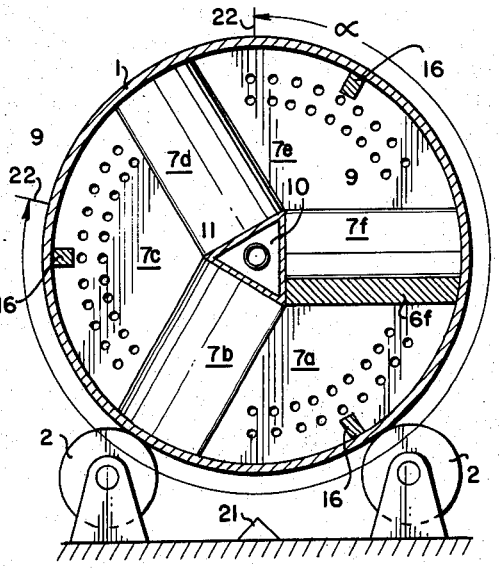
FIG. 3 is a cross-section view upon the drum from the line III—III in FIG. 1.

A view of the cross section according to line II—II of FIG. 1 shows in FIG. 2 the flat partition part 6*a* transverse to the axis of the drum 1 followed by the guide wall part 6*b*, followed by the flat partition part 6*c*, followed by the guide wall part 6*d*, followed by the flat partition part 6*e*, followed by the guide wall part 6*f*. The cross section according to the line III—III of FIG. 1 shows in FIG. 3 the flat partition part 7*a* followed by the guide wall part 7*b*, followed by the flat partition part 7*c*, followed by the guide wall part 7*d*, followed by the flat partition part 7*e*, followed by the guide wall part 7*f*.

In the flat partition parts transverse to the axis of the drum 1 there are apertures 9 disposed for the washing liquids.

In the central cover pipe 10 which is closed at one side, one or several feeding pipes 11 for washing, rinsing, and bleaching liquids or similar are disposed. Outlt openings 12 for some zones of washing into the drum interior are arranged in the cover pipe 11. The washing is fed into the drum at 13 and leaves the drum 1 at the opposite end of the drum 1 at 14. The heating means 15 is mounted preferably in one of the zones of washing in a known manner. The heating may be electrical or be steam, in a known manner. In the range of the flat partition parts 6*a*, 7*a*, etc. of the drum circumference wall one or several inner projections 16 are disposed for each zone of washing in a known manner as auxilliary means for retaining the washing in these zones of washing during the oscillatory motion of the drum 1. For the outlet of the washing detergents and the other liquids for rinsing, bleaching or the like, an outlet means 17 is disposed.

The partition means are stationarily mounted within the washing drum 1. By the action of the alternately disposed flat partition parts transverse to the axis of the drum and of the following guide wall parts inclined thereto in each partition means of the cross section of the drum the washing pieces agitate with each other in all directions because of the continuous change of their motion direction. The washing and cleaning effect during the passage of the washing through the drum is extremely high. The transfer of the washing through the drum and the time of the washing process will be essentially reduced. The disadvantageous influence of the washing detergents upon the washing and the contact of the washing with the partition parts and the inclined guide wall parts thereto inside the drum is decreased to a minimum, whereas the washing and cleaning effect is increased to a manimum. The washing fulfills rotating motions in various alternate directions and is most similar to a manual washing process, preventing a wearing out of the textiles. The zigzag motions of the washing cause a more intensive agitation of the textiles in a plurality of directions. As the zigzag motions are being continuously repeated in each zone of washing and during the whole washing process within the drum 1, the dirt particles are quickly and exactly detached out of the pores of the textile. A continuous expansion, disaggregation, and pressing of the washing improves the removal of the dirt particles out of the textile.

In order to simplify the manufacturing of the washing drum 1 all partition means have equal size and shape.

The preferable motion angle of the oscillatory motion of the drum 1 designated by $\alpha$, is about 300°, and the preferable inclination angle of the inclined guide wall parts 4*b*, 5*b*, 6*b*, etc. to the flat partition parts 4*a*, 5*a*, 6*a*, etc., designated by $\beta$, is as large as possible.

One turning mark 21 of the turning marks 21, 22 for the oscillatory motion of the drum 1 is stationarily disposed and the other turning mark 22 is disposed opposite the latter outside of the washing drum 1.

It is to be understood that the invention herein illustrated and described is to be limited only by the scope of the appended claims and that various changes may be made in details of construction without departing from the true scope of the invention.

What is claimed is:

1. A contra-flow washing machine comprising a horizontal drum, driving means for rotating said drum for washing by oscillatory motion alternatively in one direction and in reverse direction and for driving and conveying motion of the washing in a single direction only, a plurality of partition means for subdividing each cross section part of the interior of said drum into a plurality of zones of washing and for conveying the washing from one of said zones of washing into the next adjacent one, a plurality of partition means within each cross section of said drum, each of said partition means including a flat partition part transverse to the axis of the drum and a following guide part spirally inclined to said flat partition part inside the drum, of which at least one part is disposed within the range of oscillatory motion of the drum for the washing process.

2. A contra-flow washing machine as per claim 1, in which all of the said plurality of partition means in said drum have the same size and same shape.

* * * * *